US010213814B2

(12) United States Patent
Hamilton et al.

(10) Patent No.: US 10,213,814 B2
(45) Date of Patent: Feb. 26, 2019

(54) ADHESIVE ROLL

(71) Applicant: ITW LIMITED, Windsor, Berkshire (GB)

(72) Inventors: Sheila Hamilton, Kilmacolm Glasgow (GB); Stephen Frank Mitchell, Kilmacolm Glasgow (GB)

(73) Assignee: ITW LIMITED, Windsor, Berkshire (GB)

( * ) Notice: Subject to any disclaimer, the term of this patent is extended or adjusted under 35 U.S.C. 154(b) by 253 days.

(21) Appl. No.: 15/121,807

(22) PCT Filed: Jan. 5, 2015

(86) PCT No.: PCT/US2015/010118
§ 371 (c)(1),
(2) Date: Aug. 26, 2016

(87) PCT Pub. No.: WO2015/134112
PCT Pub. Date: Sep. 11, 2015

(65) Prior Publication Data

US 2017/0008041 A1 Jan. 12, 2017

(30) Foreign Application Priority Data

Mar. 5, 2014 (GB) ..... 1403851.7

(51) Int. Cl.
*B08B 7/00* (2006.01)

(52) U.S. Cl.
CPC ..... *B08B 7/0028* (2013.01)

(58) Field of Classification Search
CPC ..... B08B 7/0028; G01J 3/14
See application file for complete search history.

(56) References Cited

U.S. PATENT DOCUMENTS 2,387,512 A 10/1945 Hilberg
5,611,281 A * 3/1997 Corrado ..... B08B 1/00 101/423
5,685,043 A * 11/1997 LaManna ..... B08B 1/007 15/256.5
5,690,749 A * 11/1997 Lee ..... B08B 7/0028 134/26
5,978,630 A * 11/1999 Chang ..... G03G 15/11 15/256.52
6,055,047 A 4/2000 Schweizer et al.
6,237,176 B1 * 5/2001 Egoshi ..... B08B 7/0028 15/102
2004/0149295 A1 8/2004 Wolff et al.
(Continued)

FOREIGN PATENT DOCUMENTS

CN 102268258 A 12/2011
CN 202779063 U 3/2013
(Continued)

OTHER PUBLICATIONS

ISR and WO for PCT/US2015/010118 mailed Mar. 17, 2015.
Search Report for Great Britain application No. 1403851.7 dated Aug. 28, 2014.

*Primary Examiner* — Dung Van Nguyen
(74) *Attorney, Agent, or Firm* — Thompson Hine LLP

(57) ABSTRACT

The invention relates to an adhesive roll comprising at least one sheet of adhesive material, the sheet comprising an adhesive and being doped with at least one optically detectable dopant.

13 Claims, 8 Drawing Sheets

(56) References Cited

U.S. PATENT DOCUMENTS

| | | | | |
|---|---|---|---|---|
| 2005/0074572 | A1 | 4/2005 | Thiele | |
| 2009/0294054 | A1* | 12/2009 | Gotz | B65H 19/102 156/302 |
| 2013/0225380 | A1 | 8/2013 | Nakajima et al. | |

FOREIGN PATENT DOCUMENTS

| | | | |
|---|---|---|---|
| DE | 102008028428 | A1 | 12/2009 |
| DE | 102010041141 | A1 | 3/2012 |
| GB | 2483242 | A | 3/2012 |
| JP | H08304292 | A | 11/1996 |

* cited by examiner

ADHESIVE ROLL

RELATED APPLICATIONS

The present application is a National Phase of International Application Number PCT/US2015/010118, filed Jan. 5, 2015, and claims priority to Great Britain Application Number 1403851.7, filed Mar. 5, 2014.

The present invention relates to an adhesive roll for use in a contact cleaning process comprising an adhesive saturation indicator. The invention relates in particular, though not exclusively, to an adhesive roll for use in contact cleaning comprising at least one optically detectable dopant. In addition, this invention relates to methods and apparatus for monitoring the adhesive saturation on an adhesive roll, and in particular, but not exclusively, to methods and apparatus for monitoring the adhesive saturation, by contamination, on an adhesive roll for use in removing impurities from a cleaning surface, the cleaning surface having first removed impurities from a surface of a workpiece.

In contact cleaning an adhesive roll typically comprises a length or sheeted lengths of material located around its outer circumference. The material may be an adhesive cleaning material which can be used to remove impurities.

Conventionally, apparatus for cleaning surfaces of a workpiece comprise at least one cleaning roll which is adapted to remove impurities from the workpiece.

The cleaning roll makes contact at a point with a surface of the workpiece removing any impurities thereon as the said workpiece is conveyed past the rotatably mounted cleaning roll.

Over a period of time, the cleaning roll will become contaminated with the impurities from the workpiece.

Conventionally, an adhesive roll comprising a length or lengths of adhesive material is located adjacent to the cleaning roll. The adhesive roll makes contact at a point on the surface of the cleaning roll and in so doing, removes the impurities from the cleaning roll onto the length of the adhesive material located on the adhesive roll.

Subsequently, the said length of the adhesive material will require to be removed and replaced due to a build up of the impurities. This may be done by a user cutting away the outer circumference of the used portion of a continuous length of adhesive material, leaving behind a new portion of continuous adhesive material for use. Alternatively, the adhesive material is sheeted and, when the outermost sheet of the adhesive material requires to be removed and replaced due to a build up of the impurities, this is done simply be tearing away the contaminated sheet to reveal a fresh, uncontaminated sheet of adhesive material.

A problem arises in determining when the adhesive material is saturated with impurities and, therefore, in need of replacement or at least removal of the outermost sheet of adhesive material to reveal fresh, uncontaminated sheet of adhesive material.

Contact cleaning is used to clean substrate surfaces. Once cleaned the substrate surfaces may be used in a variety of sophisticated processes such as in the manufacturing of electronics, photovoltaics and flat panel displays. Usually, a rubber or elastomeric cleaning roller is used to remove contaminating particles from a substrate surface and an adhesive roll can then be used to remove the contaminating particles from the cleaning roller. This allows the cleaning roller to maximise its efficiency in removing contaminating particles from the substrate surface.

However, the maintenance of existing contact cleaning machines can be difficult with the removal and replacement of the rolls, both cleaning and adhesive, being time consuming and/or requiring partial disassembly of the area holding the rolls. In addition, the saturation rate of the adhesive roll with impurities is determined partly by the level of contamination of the substrates being cleaned and partly by the cleaning process being used. The saturation rate of the adhesive roll is fundamental to the success of the cleaning process. Typically such adhesive rolls consist of a core around which is wrapped at least one sheet of adhesive material, and the adhesive becomes saturated with impurities during the cleaning process. If the adhesive roll is not replaced or refreshed before the adhesive is either saturated completely or at least in part, the cleaning roller is no longer effectively cleaned by the adhesive roll and, as a result, the electronic substrate remains contaminated with impurities and goes to waste. However, taking a more cautious approach, if the adhesive roll is replaced or refreshed too soon whilst there is still an appreciable adhesive life, the overall cost of the cleaning process increases. This is a key consideration in a multi-step cleaning process. Consequently, there is a need to be able to predict the saturation of the adhesive roll with contaminating impurities accurately, repeatably and without considerable increased cost in the overall cleaning process.

The present invention aims to address these issues by providing an adhesive roll comprising at least one sheet of adhesive material, the sheet comprising an adhesive and being doped with at least one optically detectable dopant.

Preferably the at least one optically detectable dopant is detectable in a portion of the electromagnetic spectrum. Most preferably, the at least one optically detectable dopant is luminescent. More specifically, the at least one optically detectable dopant is one of: phosphorescent, fluorescent, reflective or detectable in the visible, infrared or ultraviolet regions of the electromagnetic spectrum.

In certain embodiments, the sheet may comprise a substrate layer. More specifically, the substrate layer may have an adhesive on a first side thereof.

In certain embodiments, the sheet may comprise an adhesive layer and a substrate layer.

In certain embodiments, the substrate layer may be doped with the at least one optically detectable dopant. Preferably when the substrate layer of the adhesive sheet is doped with at least one optically detectable dopant, the adhesive is at least partially transparent at a wavelength at which the dopant is optically detectable.

If the substrate layer is doped with the at least one optically detectable dopant, and the at least one optically detectable dopant is phosphorescent or fluorescent, the adhesive may be transparent to the wavelength at which the dopant phosphoresces or fluoresces.

Alternatively, or in addition, the adhesive may be doped with the at least one optically detectable dopant. More specifically, the adhesive layer may be doped with the at least one optically detectable dopant.

Preferably, the optical response of the adhesive material at the wavelength is proportional to the level of impurity contamination in the adhesive. More preferably, the optical response of the adhesive material is approximately linear for at least a portion of the level of impurity contamination in the adhesive. Most preferably, in use, the adhesive material tends towards a level of impurity contamination in the adhesive at which the optical response demonstrates an abrupt change at the saturation point of contamination of the adhesive, or a measurable saturation threshold indicating that this point is about to be reached.

By using an optically detectable dopant it is possible to monitor the rate of contaminant saturation of the adhesive on the adhesive roll, by monitoring the resultant change in the detectable optical response from the optically detectable dopant as the contaminant level on the adhesive roll increases, thus providing an indication of a saturation point when the adhesive material is at a point where it must be replaced or refreshed to remain effective. This is ideal when the roll is used in a contact cleaning apparatus or process, since the saturation point can be used to indicate when the roll should be replaced or refreshed.

Preferably a change in the optical response of the adhesive material at the wavelength at which the dopant phosphoresces or fluoresces is proportional to the level of impurity contamination in the adhesive. More specifically, the change in the optical response is a detectable measure of adhesive saturation on the adhesive roll.

The adhesive roll preferably comprises a core and at least one sheet of adhesive material, the at least one sheet of adhesive material being wrapped around the outer surface of the core.

The emission radiation from the at least one optically detectable dopant is preferably in the visible portion of the electromagnetic spectrum.

In certain embodiments, the at least one optically detectable dopant is preferably a fluorescent paint.

Alternatively, the at least one optically detectable dopant is preferably a phosphorescent pigment.

The at least one optically detectable dopant may be strontium aluminate. Alternatively, or in addition, the at least one optically detectable dopant may comprise radium and/or zinc sulphide.

In certain embodiments, the at least one optically detectable dopant may comprise one or more of strontium aluminate, radium or zinc sulphide.

In certain embodiments, wherein the at least one optically detectable dopant comprises strontium aluminate, at least a portion of the at least one optically detectable dopant may be coated in a first material the first material having a first emission colour in the visible portion of the electromagnetic spectrum when the at least one optically detectable dopant is subjected to a predetermined excitation energy.

In alternative or additional embodiments wherein the at least one optically detectable dopant comprises strontium aluminate, at least a portion of the at least one optically detectable dopant may be coated in a second material the second material having a second emission colour in the visible portion of the electromagnetic spectrum when the at least one optically detectable dopant is subjected to a predetermined excitation energy.

It should be understood that the, or each, coating material on the at least one optically detectable dopant may be selected to have any given emission colour of visible light when the at least one optically detectable dopant is subjected to a predetermined excitation energy in the electromagnetic spectrum. As such, batches of at least one optically detectable dopant having alternative detectable emission colours may be manufactured such that changes in the at least one optically detectable dopant coating may be used to track batches of the adhesive roll product and, thereby, function as a quality control and/or an anti-counterfeiting measure.

The at least one optically detectable dopant may be present in the adhesive at 0 to 5% weight/weight. Preferably the at least one optically detectable dopant is present in the adhesive in a range of between 0.1 and 5% weight/weight.

Alternatively, or in addition, the at least one optically detectable dopant may be present in the substrate layer at 0 to 5% weight/weight. Preferably the at least one optically detectable dopant is present in the substrate layer in a range of between 0.1 and 5% weight/weight.

As the adhesive material becomes saturated with contaminants, the measurable luminescence emitted by the adhesive material may reduce. This is as a result of the detectable optical emission from the dopant being occluded by the contaminants on the adhesive material.

Alternatively, if the contaminants themselves are luminescent, as the adhesive material becomes saturated with contaminants, the measurable luminescence from the adhesive material may increase. This is as a result of the detectable optical emission from the dopant being additive with the optical emission from the contaminants on the adhesive material.

The change in the measurable luminescence is detectable and the adhesive sheet may be changed when a threshold level of measurable luminescence is reached or, alternatively, when the change in measurable luminescence is such that a predetermined saturation threshold has been reached.

In certain embodiments, the adhesive material is a continuous length of adhesive material.

In certain embodiments, the adhesive material is sheeted. More specifically, the adhesive roll is a sheeted roll comprising one or more sheets of adhesive material.

In certain embodiments, the sheeted adhesive roll comprises at least two sheets of adhesive material.

More specifically, adhesive material sheets may be cut between adjacent sheets.

Alternatively, adjacent sheets may be sheeted by being perforated between adjacent sheets. More specifically, the adjoining sheets are connected to one another initially along a line of weakening. The line of weakening being provided by perforations in the sheet material joining the adjacent sheets.

In certain embodiments, the adhesive roll comprises a roll core having at least one sheet of adhesive material removably attachable thereon.

In certain embodiments, the adhesive roll further comprises at least one subsequent sheet of adhesive material being removably attachable on the at least one previous sheet of adhesive material on the roll core.

In certain embodiments, the adhesive roll further comprises a plurality of subsequent sheets of adhesive material with each sheet being removably attachable on the previous sheet of adhesive material on the roll core.

In such embodiments, the, or each, sheet and subsequent sheets of adhesive material providing an adhesive surface holding the sheets to one another on said roll core.

Preferably, the adhesive material comprises an adhesive which permits to remove impurities.

The adhesive may be self-adhesive material having a pressure-sensitive adhesive thereon.

The sheets may be rolled successively around the cylindrical core adhesive side out.

The adhesive material may be coated with a release coating which facilitates removal of each sheet.

Alternatively, or in addition, the adhesive material may comprise an embossed surface which facilitates removal of each sheet.

In another aspect the present invention also provides the use of such an adhesive roll in a contact cleaning process.

According to a further aspect of the present invention there is provided an apparatus for monitoring adhesive contaminant saturation of an adhesive roll comprising at least one sheet of adhesive material, the sheet comprising an adhesive and being doped with at least one optically detectable dopant, the apparatus comprising an excitation energy source operable to deliver excitation energy to the optically detectable dopant;

an optical detector operable to detect optical emissions from the at least one optically detectable dopant and to output a signal proportional to the detected optical emissions; and a monitoring device operable to monitor the output signal from the detector and to detect a change in the output signal from the detector.

In certain embodiments, the monitoring device is operable to detect an increase in the output signal from the detector. An increase in the output signal being indicative of an increase in the detectable optical emissions from the adhesive material.

In certain embodiments, the monitoring device is operable to detect a decrease in the output signal from the detector. Any decrease in the output signal being indicative of a decrease in the detectable optical emissions from the adhesive material.

A change in the output signal from the detector may be caused as a result of contaminants on the adhesive material occluding the optically detectable emissions from the optically detectable dopant and/or as a result of contaminants on the adhesive material reducing the excitation energy reaching the optically detectable dopant.

Alternatively, a change in the output signal from the detector may be caused as a result of contaminants on the adhesive material themselves being capable of generating optically detectable emissions; thus the optically detectable emissions resulting from the contaminants will increase the optically detectable emissions from the optically detectable dopant thereby increasing the output signal from the optical detector.

The optical detector may be a phosphorescence detector.

The optical detector may be a fluorescence detector.

The excitation energy source preferably generates and outputs electromagnetic radiation. More specifically, the electromagnetic radiation may be of a wavelength which causes the optically detectable dopant to emit optically detectable radiation.

The monitoring device may be a processor unit. Preferably the processor unit is programmable.

Preferably, the processor unit is programmable to generate an alarm signal when a pre-determined threshold output signal is detected.

According to a yet further aspect of the present invention, there is provided a method for monitoring adhesive contaminant saturation of an adhesive roll comprising at least one sheet of adhesive material, the sheet comprising an adhesive and being doped with at least one optically detectable dopant, the method comprising the steps of:

providing an excitation energy source;

delivering excitation energy from the excitation energy source to the optically detectable dopant;

providing an optical detector and detecting the optical emissions from the at least one optically detectable dopant;

providing an output signal from the optical detector proportional to the detected optical emissions;

providing a monitoring device and monitoring the output signal from the detector and detecting a change in the output signal from the detector.

The monitoring device may be a processor unit. In such embodiments, the method may further comprise the step of programming the processor unit to detect a pre-determined threshold output signal from the monitoring device. The signal may be indicative of a saturated adhesive roll.

The method provides a way of measuring a change in the luminescence of an adhesive material containing an optically detectable dopant for a given excitation energy over time. As the adhesive material becomes saturated with contaminant impurities, the luminescence from the optically detectable dopant will change for a pre-determined and constant excitation energy input from an excitation source. The luminescence of the adhesive roll in its unused condition will be known. The change in luminescence of the adhesive roll for a pre-determined excitation energy can be monitored over time as the adhesive roll picks up contaminants. When the change reaches a pre-determined threshold level, the adhesive roll should be replaced or refreshed by removing the outer layer/sheet of adhesive material.

The present invention will now be described by way of example only, and with reference to the accompanying drawings, in which.

In the present invention it has been appreciated that adhesive rolls can be manufactured in a manner that allows remote and contact-free monitoring of their adhesive saturation with impurities during a contact cleaning process. Adhesive rolls comprising at least one sheet of adhesive material wherein the sheet comprises an adhesive can be formed such that the sheet is doped with an optically detectable dopant. By using optical monitoring of the dopant the saturation of the adhesive with contamination in the form of impurities can be determined from the optical response measured as the adhesive becomes saturated with impurities during the contact cleaning process. By choosing a dopant giving an optical response that is proportional to the level of contamination of the adhesive sheet, a threshold level of contamination indicating saturation of the adhesive can be defined by monitoring a change in the optical response. This can be achieved by adapting the dopant and/or the adhesive, as described below.

Figure 1:
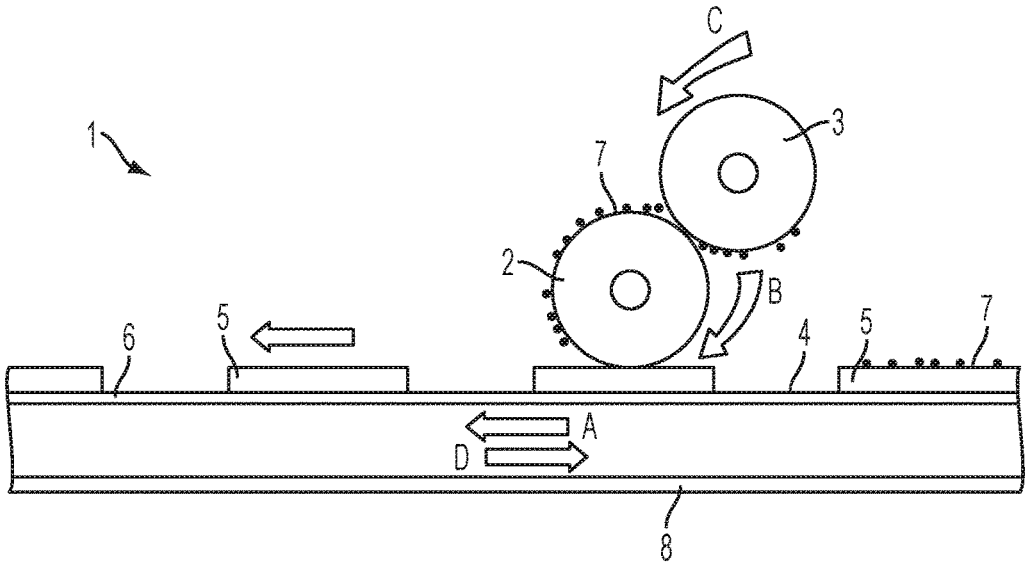
FIG. 1 is a schematic side view of a contact cleaning apparatus employing an adhesive roll in accordance with embodiments of the present invention.

FIG. 1 is a schematic side view of a contact cleaning apparatus employing an adhesive roll in accordance with embodiments of the present invention. The contact cleaning apparatus 1 comprises a contact cleaning roll 2 and an adhesive roll 3 mounted above a conveyor 4 on which a plurality of substrates 5 for cleaning are carried. The contact cleaning roll 2 is elongate and generally cylindrical in shape, and is mounted on a holder (not shown) having an axis perpendicular to the plane of view about which the contact cleaning roll 2 is free to rotate. The specific structure of the contact cleaning roll 2 is described in more detail below. The adhesive roll 3 is generally cylindrical in shape, and comprises a core having a surface on which adhesive is present, and is also mounted on a holder (not shown) having an axis perpendicular to the plane of view and parallel to that of the contact cleaning roll 2 about which the adhesive roll 3 is free to rotate. The contact cleaning roll 2 and adhesive roll 3 are mounted in such a manner so as to be in contact with one another such that clockwise rotational movement of the contact cleaning roll 2 results in counter-clockwise rotational movement of the adhesive roll 3 and vice versa. The need for the contact cleaning roll 2 and adhesive roll 3 to be in contact will be clear from the description of use below. The contact cleaning roll 2 is also mounted so as to be able to be in contact with the surface of a substrate 5 to be cleaned as it passes on a conveyor located below the axis of the conveyor 4.

Substrates 5 to be cleaned are processed as follows. A substrate 5 is positioned on the upper surface 6 of a conveyor 4, which moves from right to left as indicated by arrow A. The substrate 5 to be cleaned passes underneath the contact cleaning roll 2, which rotates in a clockwise direction as indicated by arrow B. Before coming into contact with the contact cleaning roll 2, the upper surface of the substrate 5 is covered with debris 7 requiring removal, such as dust. The contact cleaning roll 2 contacts the upper surface of the substrate 5, removing the debris 7 by means of an electrostatic removal mechanism, where the inherent polarity of the material used to form the contact cleaning roll 2 attracts the debris 7 and causes it to stick to the surface of the contact cleaning roll 2. The relative attractive force between the surface of the contact cleaning roll 2 and the debris 7 is greater than that between the debris 7 and the surface of the substrate 5, hence the debris 7 is removed. The now clean substrate 5 continues along the conveyor 4 to a removal station (not shown) and the lower surface 8 of the conveyor passes back, forming a loop, in a left-right direction in FIG. 1, as indicated by arrow D. In order to clean the contact cleaning roll 2, the adhesive roll, rotating in a counter-clockwise direction as indicated by arrow C contacts the surface of the contact cleaning roll 2. At this point the adhesive force between the debris 7 and the adhesive present on the surface of the adhesive roll 3 is greater than the electrostatic force holding the debris 7 onto the surface of the contact cleaning roll 2, and the debris is removed. The contact cleaning roll 3 then rotates to present a clean surface to the next substrate 5 to be cleaned.

Figure 2:
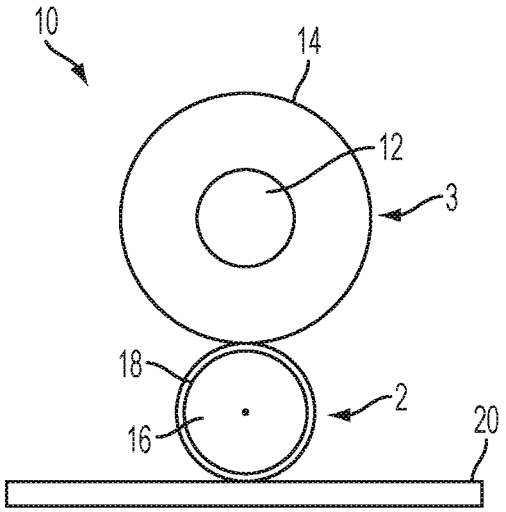
FIG. 2 is a side view of an apparatus for cleaning a workpiece.

Referring to FIG. 2, an apparatus 10 for cleaning a workpiece 20 advantageously comprises at least one cleaning roll 2 having a core 16 and a cleaning surface 18, and an adhesive roll 3 having a roll core 12 having a continuous length of adhesive material 14 with an adhesive surface.

The cleaning roll 2 is rotatably mountable adjacent to the workpiece 20 in such a way that allows the cleaning surface 18 to be in contact at a point on a surface of the workpiece 20. Hence, as the workpiece 20 is conveyed, the cleaning roll 2 rotates and the cleaning surface 18 of the cleaning roll 2 removes any impurities located on the workpiece 20.

The cleaning surface 18 is typically elastomer coated or made of other forms of rubber or like material to facilitate the removal of impurities from the workpiece 20.

The roll core 12 is mountably rotatable adjacent the cleaning roll 2 relative to the workpiece 20. The roll core 12 and continuous adhesive material 14 is in contact at a point with the cleaning surface 18 of the cleaning roll 2.

The continuous adhesive material 14 facilitates the removal of impurities from the cleaning surface 18 of the cleaning roll 2 to the continuous adhesive material 14 by virtue of being in contact at a point on the cleaning surface 18.

The continuous adhesive material 14 is applied in this way, as opposed to being directly applied onto the conveyed workpiece 20, to avoid contaminating the workpiece 20 with adhesive from the continuous adhesive material 14.

When the continuous adhesive material 14 becomes contaminated, replacement is achieved by a user cutting away the contaminated portion of the continuous adhesive material 14, leaving behind a new clean portion of continuous adhesive material 14 for use.

Figure 3:
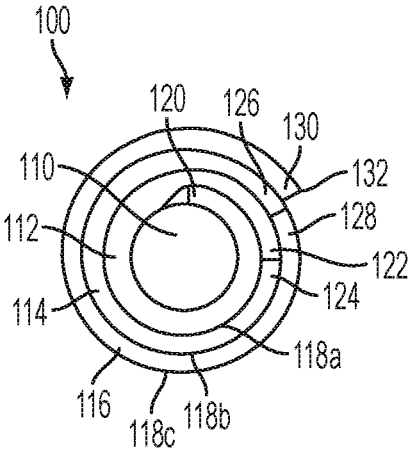
FIG. 3 is a view from one end of an adhesive roll illustrating how sheets of material are superimposed onto a roll core.

As shown in FIG. 3, an adhesive roll for use in contact cleaning may be formed as a sheeted roll 100 which comprises a conventional roll core 110 with individual adhesive sheets 112, 114, 116 removably attachable around the circumference of the roll core 110 superimposed onto one another.

The roll core 110 has an attachment means which may be an adhesive coating to allow the first individual adhesive sheet 112 to be removably attachable around the circumference of the roll core 110.

The individual adhesive sheets 112, 114, 116 have an adhesive surface 118*a-c* facing outwardly, and have a non-adhesive surface facing inwardly.

The sheeted roll 100 is formed by attaching a first end 120 of the first sheet 112 onto the roll core 110 and wrapping the first sheet 112 around the circumference of the roll core 110.

The other end 122 of the first sheet 112 will overrun end 120 by virtue of the first sheet 112 being greater in length than the circumference of the roll core 110.

The end 122 is removably attached on end 120 by the adhesive surface 118*a* of the first sheet 112.

A second sheet 114 is then wrapped around the outer circumference of the first sheet 112 with end 124 of the second sheet 114 being abutted to end 122 of the first sheet 112. The term abutted is to be understood to include being adjacent to; there may be a gap between successive sheets.

The adhesive surface 118*a* of the first sheet 112 will securely hold in place the second sheet 114.

A third sheet 116 is then wrapped around the outer circumference of the second sheet 114 with end 128 of the third sheet 116 being abutted to end 126 of the second sheet 114.

The adhesive surface 118*b* of the second sheet 114 will securely hold in place the third sheet 116.

Similarly, further individual adhesive sheets (not shown) are abutted to end 130 of the third sheet 116 and so on until the roll core 110 is "full".

It will be realised that because the sheets 112, 114, 116 are all of the same length, the overrun or circumferential offset of the respective ends 122, 126, 130, and so on, will decrease as the roll core 12 becomes "full". The length of each sheet can however be adjusted as desired or required.

The offset of the abutment of the ends of the sheets disperses the load on the roll core 110 making the roll core 110 more stable when rotating.

In use, the roll core 110 is positioned such that the outermost sheet is positioned in contact at a point with the cleaning surface 18 of the conventional cleaning roll 16.

As both the roll core 110 and the cleaning roll 16 rotate, impurities located on the cleaning surface 18 will be transferred to the adhesive surface 118*c* of the outer sheet 116.

When the adhesive surface 118*c* of the outer sheet 116 becomes contaminated, replacement is achieved by peeling the contaminated sheet 116 away by virtue of lip 132, thus leaving behind a clean sheet 114 to be applied to the cleaning surface 18 of the cleaning roll 16, until that too needs replaced, and so on.

Figure 4:
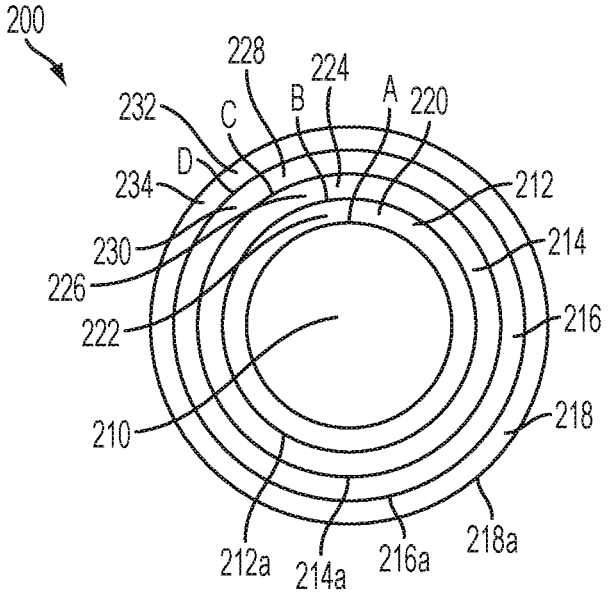
FIG. 4 is a view from one end illustrating an alternative to how sheets of material are superimposed onto an adhesive roll.

As shown in FIG. 4, an alternative sheeted roll 200 comprises a conventional roll core 210 with individual adhesive sheets 212, 214, 216, 218, and so on, removably attachable around the circumference of the roll core 210 superimposed onto one another.

In this arrangement, a first sheet 212 is attached to the roll core 210. The sheet 212 has an adhesive surface 212*a* which faces outwardly and has a non-adhesive surface which faces inwardly. The length of the first sheet 212 is equivalent to the circumference of the roll core such that the ends 220, 222 of which abut with one another. Abut should be understood to include the ends being adjacent to one another; there may be a gap between successive sheets.

A second sheet 214 is then removably attached to the first sheet 212, by virtue of the adhesive surface 212*a* of the first sheet 212. The length of this second sheet 214 is such that corresponding ends 224, 226 of the second sheet 214 abut with one another.

Similarly further sheets 216, 218, and so on, are removably attached to previous sheets 214, 216, 218, and so on. These further sheets 216, 218, and so on, are held securely in place by virtue of the adhesive surfaces 214*a*, 216*a*, 218*a*, and so on.

Points A, B, C, D indicate the position of abutment of the respective ends 220, 222, 224, 226, 228, 230, 232, 234. These points A, B, C, D are circumferentially spaced around the roll core 210 to facilitate replacement of the sheets 212, 214, 216, 218, and to maintain the structural integrity of the sheeted roll 200.

The length of each sheet can be adjusted as the roll becomes more "full" and the effective circumference becomes larger.

Figure 5:
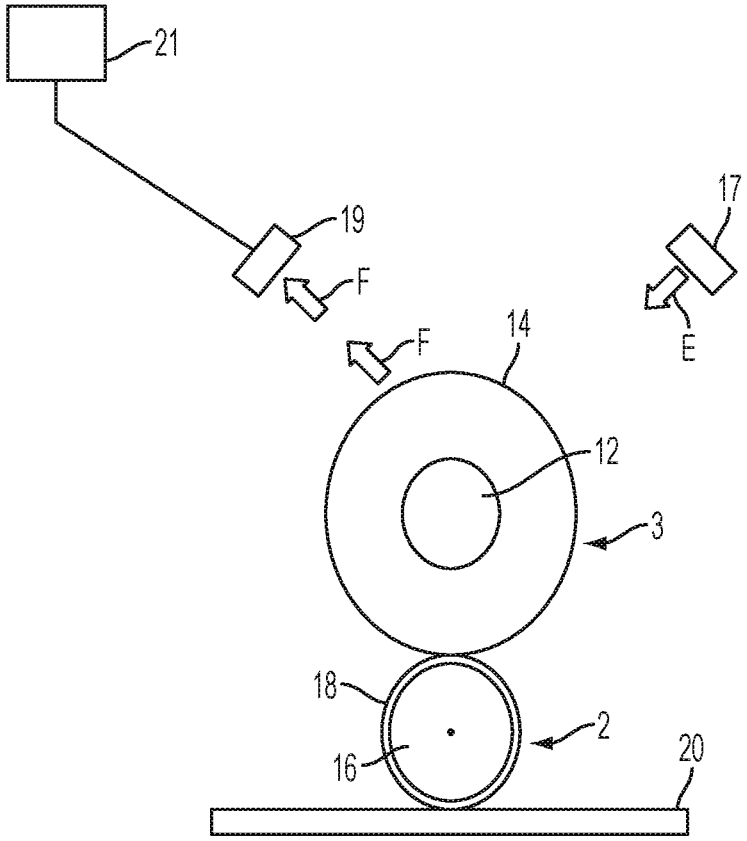
FIG. 5 is a schematic side view of an apparatus for monitoring adhesive saturation in an adhesive roll in accordance with a first embodiment of the present invention wherein the optically detectable dopant is a phosphorescent pigment.

FIG. 5 is a schematic side view of an apparatus for monitoring adhesive saturation in an adhesive roll in accordance with a first embodiment of the present invention. The roll is used as an adhesive roll 3 for contact with a contact cleaning roll 2 having a core 16 and a cleaning surface 18 in a contact cleaning system 1 as described above. Apparatus comprises an adhesive roll 3 comprising a core 12 and at least one sheet of adhesive material providing an adhesive surface 14 wound around the core 12. The at least one sheet of adhesive material comprises a substrate layer coated with an adhesive layer. The adhesive roll 3 is elongate and generally cylindrical in shape, and is mounted via a mounting mechanism onto a holder (not shown) for use in a contact cleaning system (see FIG. 1). The adhesive layer is doped with an optically detectable dopant. In the depicted embodiment, the dopant is a phosphorescent pigment. The luminescent material in a preferred embodiment is strontium aluminate.

An excitation energy source 17 is positioned with respect to the adhesive roll 3 such that it is operable to emit excitation energy in a direction E toward the adhesive roll 3 comprising the optically detectable dopant. The excitation energy source 17 is positioned to emit excitation energy onto the adhesive material such that the phosphorescent material emits detectable light in a direction F. In exemplary embodiments, the excitation energy is emitted from the excitation energy source 17 at a wavelength of 300 nm. An optical detector device 19 is positioned with respect to the adhesive roll 3 such that it is operable to detect an optical signal emitted by the optically detectable dopant in response to it absorbing excitation energy from the excitation energy source 17. In exemplary embodiments, the excitation energy source 17 may be an ultraviolet light source. The excitation energy source 17 may be a tungsten white light source, an LED source or other similar source of excitation energy.

The optical detector device 19 is circumferentially offset from the excitation energy source 17. The distance of the circumferential offset between the excitation energy source 17 and the optical detector 19 will depend upon the decay time of the phosphorescence of the phosphorescent pigment. The phosphorescent decay curve (see FIG. 8 for an example) is not linear. It is much by preference that the circumferential offset between the excitation energy source 17 and the optical detector 19 for any given phosphorescent pigment is selected to ensure there is sufficient detectable phosphorescence to detect.

The optical detector 19 may be an optical cell. In embodiments of the invention, the detector 19 may be a current charge device (CCD), for example.

In operation of the apparatus, the ultraviolet excitation energy source 17 emits excitation energy and the phosphorescent pigment in the adhesive material begins to phosphoresce. As the adhesive roll 3 rotates, the activated phosphorescent pigment emits an optically detectable signal which, in turn, is detected by the optical detector 19 as the adhesive material 14 rotates.

When a new, unused adhesive roll 3 is mounted into the apparatus, the apparatus is calibrated by measuring the baseline phosphorescence of the adhesive material 14 in an uncontaminated condition. As the adhesive roll 3 is used and the levels of impurities on the adhesive material 14 increases, the detector 19 monitors the change in phosphorescence relative to the baseline until a pre-determined threshold level of change in phosphorescence is reached. In exemplary embodiments, an alarm would be triggered to alert the operator that the adhesive roll 3 should be changed or refreshed.

The substrate layer of the adhesive material 14 may be formed form paper or a polymeric material, for example.

A processor unit 21 may be programmed to monitor the change in the optical signal detected by the optical detector 19. The processor unit 21 may provide an alarm signal when a pre-determined threshold change in the optical signal relative to the baseline phosphorescence is detected.

In the initial unused and uncontaminated state, the optically detectable dopant is maximally detectable. The optically detectable dopant is detected by the optical detector 19 looking at the optical response of the roll 3, for example, by measuring an intensity of the luminescence. In order to measure the optical response it may be necessary to use a specific optical source or a specific detector 19, for example, one that is able to detect luminescent material.

In use, the adhesive 14 picks up impurities from the adjacent cleaning roll 2 (see FIG. 1) as it comes into repeated contact with cleaning roll 2 to be cleaned. The contamination of the outer surface of the adhesive 14 over time results in the optical response of the optically detectable dopant changing.

Figure 6:
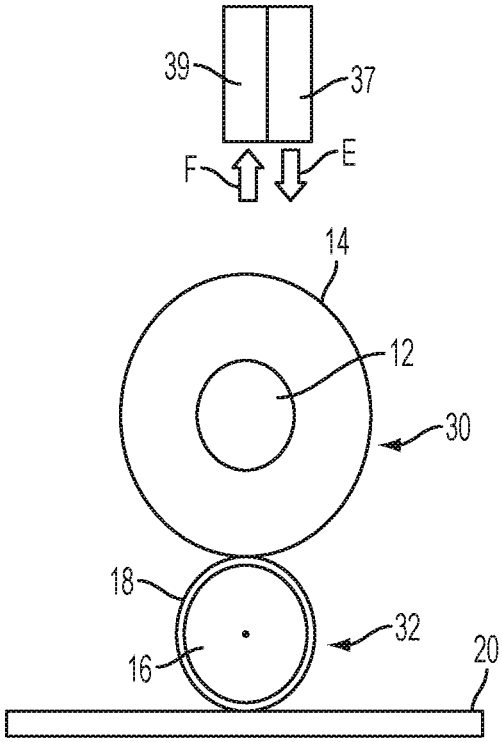
FIG. 6 is a schematic side view of an apparatus for monitoring adhesive saturation in an adhesive roll in accordance with an alternative embodiment of the present invention wherein the optically detectable dopant is a reflective material.

FIG. 6 is a schematic side view of an apparatus for monitoring adhesive saturation in an adhesive roll in accordance with a second embodiment of the present invention. The apparatus differs from the embodiment shown in FIG. 5 in that the excitation energy source 37 and the optical detector 39 are not circumferentially offset from one another. The depicted apparatus is useful in a system wherein the optically detectable dopant is a reflective material. In such embodiments, the excitation energy source 37 may be an illuminator and the optical detector 39 may be a light sensor.

When a new, unused adhesive roll 30 is mounted into the apparatus adjacent a cleaning roll 32 comprising a core 16 and a cleaning surface 18, the apparatus is calibrated by measuring the baseline reflection of the adhesive material 14 in an uncontaminated condition. As the adhesive roll 30 is used and the levels of impurities on the adhesive material 14 increases, the detector 39 monitors the change in reflection relative to the baseline until a pre-determined threshold level of change in reflection is reached. In exemplary embodiments, an alarm would be triggered to alert the operator that the adhesive roll 30 should be changed or refreshed.

Figure 7:
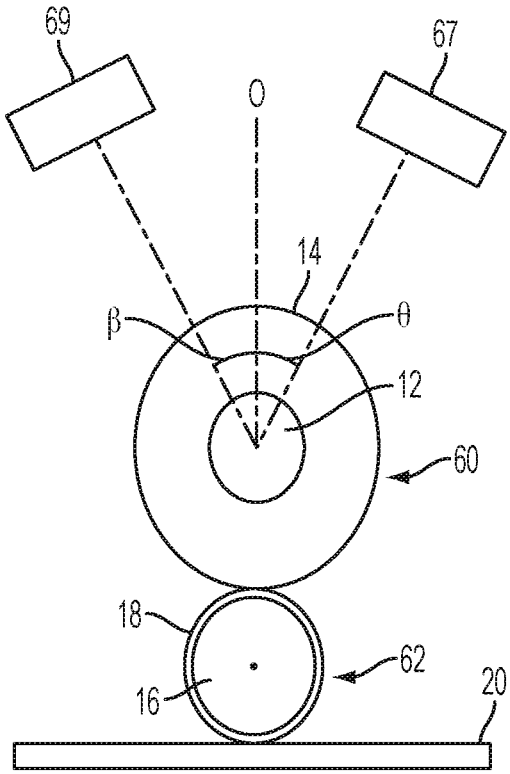
FIG. 7 is a schematic side view of an apparatus for monitoring adhesive saturation in an adhesive roll in accordance with a yet further alternative embodiment of the present invention wherein the optically detectable dopant is a fluorescent or a reflective material.

FIG. 7 is a schematic side view of an apparatus for monitoring adhesive saturation in an adhesive roll 60 in accordance with a further embodiment of the present invention. The apparatus differs from the embodiment shown in FIG. 5 in that the excitation energy source 67 and the optical detector 69 are circumferentially offset from one another and are equidistant from a radius "O" of the adhesive roll 60 at 0 degrees rotation. The circumferential offset distance between the excitation energy source 67 and the detector 69 is important and will change as the diameter of the adhesive roll 60 changes. The angle of incidence, $\sigma$, of the excitation energy and the angle of reflection, $\beta$, of the emitted energy from the dopant are, most preferably, equal with respect to the radius "O".

The depicted apparatus is useful in a system wherein the optically detectable dopant is a fluorescent or reflective material. In such embodiments, the excitation energy source 67 may be an illuminator and the optical detector 69 may be a light sensor.

When a new, unused adhesive roll 60 is mounted into the apparatus, the apparatus is calibrated by measuring the baseline fluorescence or reflection of the adhesive material 14 in an uncontaminated condition. As the adhesive roll 60 is used and the levels of impurities on the adhesive material 14 increases, the detector 69 monitors the change in fluorescence or reflection relative to the baseline until a pre-determined threshold level of change in fluorescence or reflection is reached. In exemplary embodiments, an alarm would be triggered to alert the operator that the adhesive roll 60 should be changed or refreshed.

Although in the above exemplary embodiments an ultraviolet light source is used. Depending on the optically detectable dopant selected it may be desirable to use a visible, infrared or other light source.

Figure 8:
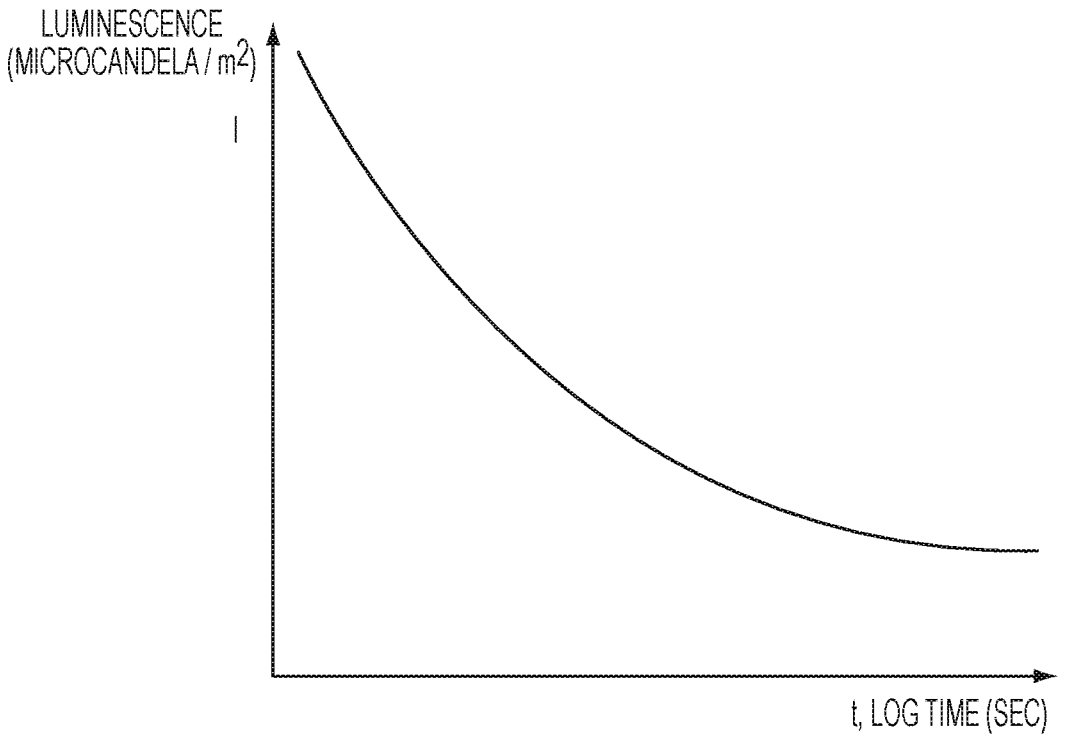
FIG. 8 is a schematic graph showing the phosphorescence decay profile of a phosphorescent pigment.

FIG. 8 is a schematic graph showing the phosphorescence decay profile of a phosphorescent pigment. The optical emission intensity, I, and the time, t, for the phosphorescence to decay will be dependent upon the phosphorescent pigment used and the concentration of the pigment in the adhesive.

Figure 9:
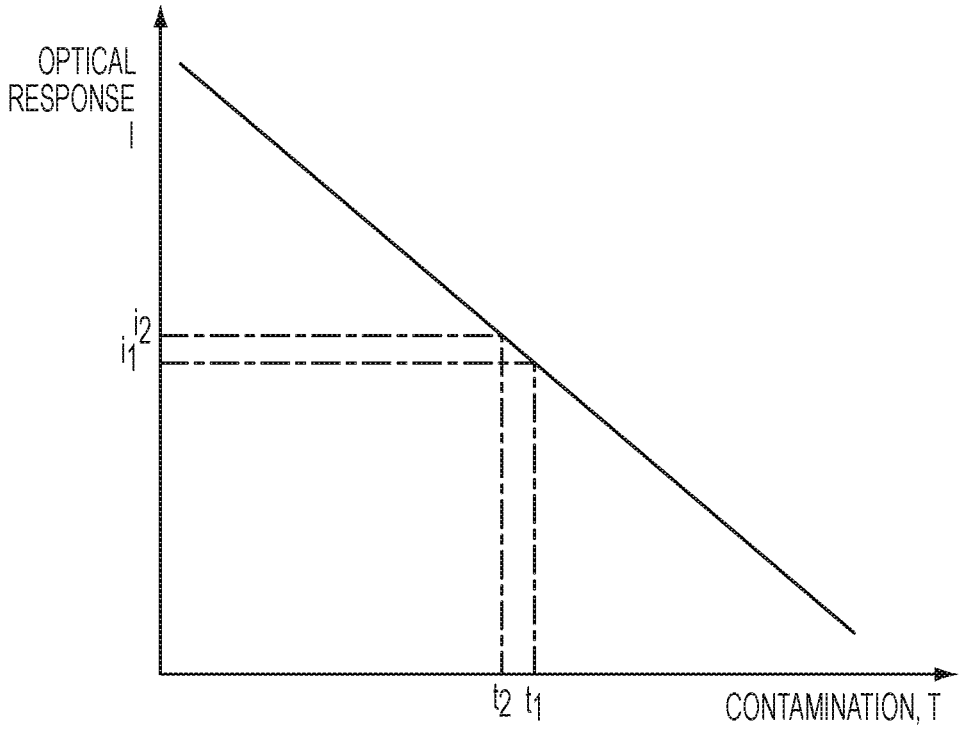
FIG. 9 is a schematic graph showing the optical response of a roll in accordance with an embodiment of the present invention.

FIG. 9 is a schematic graph showing the optical response of a roll in accordance with an embodiment of the present invention. The x-axis represents the contamination level, T, and they-axis represents optical response, in this case, the intensity I of the luminescence of the adhesive 14 detected. The optically detectable dopant and the material forming the adhesive 14 are chosen such that the optical response of the adhesive 14 is approximately linear for at least a portion of the contamination level T of the adhesive 14. At a point where the contamination level of the adhesive 14 is $t_1$, the optical response $i_1$ represents a pre-determined saturation threshold point at which the adhesive roll 3 should be changed or refreshed. Thereafter the optical response continues to decrease compared to the initial optical response, and in this example remains linear. However, the optical response may be exponential, logarithmic or a step change at this point. This saturation threshold point is engineered to allow the easy detection of a point at which it is desirable to change the roll 3. At this point there is sufficient uncontaminated adhesive 14 remaining on the roll 3 to avoid damage to the substrates 5 to be cleaned but this is an acceptable minimum indicating that the useful lifetime of the roll 3 has been achieved.

In the depicted embodiment, the saturation threshold point of contamination $t_1$ of the adhesive 14 provides a threshold optical response $i_1$. The user will be aware that at the optical response threshold $i_1$ the adhesive roll should be changed in favour of a fresh adhesive roll.

However, it may be more desirable for the user to be able to change the adhesive roll 3 before this saturation threshold is reached. Consequently a second point $t_2$ can be defined, wherein at $t_2$ the optical response $i_2$ demonstrates a measurable pre-saturation threshold level. This threshold may be defined for the roll either with or without a calibration of the initial optical response. Preferably $t_2$ is defined as an adhesive contaminant saturation at which it is most desirable to change the adhesive roll 3, rather than being a critical point in terms of the maximum useful lifetime of the adhesive roll 3. Consequently rather than an acceptable minimum uncontaminated adhesive, as with $t_1$, $t_2$ represents a workable minimum uncontaminated adhesive indicating that the workable lifetime of the roll 3 has been achieved.

These and other embodiments of the present invention will be apparent from the scope of the appended claims.

Modifications and improvements may be made to the above without departing from the scope of the present invention. It is clear that the forgoing provides sheeted rolls with the adhesive facing outwardly. Also, for example, the sheeted roll may have a roll core with individual sheets of any length removably attachable onto the roll core.

The invention claimed is:

1. An adhesive roll comprising at least one sheet of adhesive material, the sheet of adhesive material comprising an adhesive layer and a substrate layer, and at least one of the adhesive layer or the substrate layer being doped with at least one optically detectable dopant.

2. An adhesive roll according to claim 1, wherein the at least one optically detectable dopant is luminescent.

3. An adhesive roll according to claim 1, wherein the at least the first optically detectable dopant is one of: phosphorescent, fluorescent, reflectescence or detectable in the visible, infrared or ultraviolet regions of the electromagnetic spectrum.

4. An adhesive roll according to claim 1, wherein the adhesive layer is at least partially transparent at a wavelength at which the dopant is optically detectable.

5. An adhesive roll according to claim 1, wherein the adhesive layer is doped with the at least one optically detectable dopant.

6. An adhesive roll according to claim 1, wherein the at least one optically detectable dopant is a fluorescent paint.

7. An adhesive roll according to claim 1, wherein the at least one optically detectable dopant is preferably a phosphorescent pigment.

8. An adhesive roll according to claim 7, wherein the at least one optically detectable dopant is: strontium aluminate, radium and/or zinc sulphide.

9. An adhesive roll according to claim 8, wherein, when the at least one optically detectable dopant is strontium aluminate, at least a portion of the at least one optically detectable dopant is coated in a first material the first material having a first emission colour in the visible portion of the electromagnetic spectrum.

10. An adhesive roll according to claim 9, wherein at least a portion of the at least one optically detectable dopant is coated in a second material the second material having a second emission colour in the visible portion of the electromagnetic spectrum.

11. Use of an adhesive roll according to claim 1 in a contact cleaning process.

12. An apparatus for monitoring adhesive contaminant saturation of an adhesive roll comprising at least one sheet of adhesive material, the sheet comprising an adhesive and being doped with at least one optically detectable dopant, the apparatus comprising an excitation energy source operable to deliver excitation energy to the optically detectable dopant;

an optical detector operable to detect optical emissions from the at least one optically detectable dopant and to output a signal proportional to the detected optical emissions; and a monitoring device operable to monitor the output signal from the detector and to detect a change in the output signal from the detector.

13. A method for monitoring adhesive contaminant saturation of an adhesive roll comprising at least one sheet of adhesive material, the sheet comprising an adhesive and being doped with at least one optically detectable dopant, the method comprising the steps of:

providing an excitation energy source;

delivering excitation energy from the excitation energy source to the optically detectable dopant;

providing an optical detector and detecting the optical emissions from the at least one optically detectable dopant;

providing an output signal from the optical detector proportional to the detected optical emissions;

providing a monitoring device and monitoring the output signal from the detector and detecting a change in the output signal from the detector.

* * * * *